US006439526B1

(12) United States Patent
London

(10) Patent No.: US 6,439,526 B1
(45) Date of Patent: Aug. 27, 2002

(54) JOINTED CLAMP FOR GARMENT BAG

(75) Inventor: Wallace London, Baltimore, MD (US)

(73) Assignee: Clemco Products, Inc., Baltimore, MD (US)

( * ) Notice: Subject to any disclaimer, the term of this patent is extended or adjusted under 35 U.S.C. 154(b) by 0 days.

(21) Appl. No.: 09/294,873

(22) Filed: Apr. 20, 1999

(51) Int. Cl.[7] ..... B65D 85/18
(52) U.S. Cl. ..... 248/316.5; 206/285; 206/287
(58) Field of Search ..... 248/316.5; 206/287, 206/285, 279; 403/363; 411/396

(56) References Cited

U.S. PATENT DOCUMENTS

| | | | | | |
|---|---|---|---|---|---|
| 2,606,636 | A | | 8/1952 | Braverman | 190/43 |
| 2,671,706 | A | | 3/1954 | Greengold | 312/4 |
| 2,689,631 | A | | 9/1954 | Marks | 190/18 |
| 2,862,586 | A | | 12/1958 | Davis | 190/43 |
| 3,000,145 | A | * | 9/1961 | Fine | 403/363 |
| 3,221,848 | A | | 12/1965 | O'Neil | 190/43 |
| 3,566,456 | A | | 3/1971 | London | 24/248 |
| 3,958,675 | A | | 5/1976 | Rosenblum | 190/43 |
| 4,252,220 | A | * | 2/1981 | London et al. | 206/287 |
| RE31,075 | E | | 11/1982 | London et al. | 190/41 |
| 4,363,388 | A | * | 12/1982 | London et al. | 206/287 |
| 4,618,058 | A | | 10/1986 | Gregg et al. | 206/291 |
| 4,640,414 | A | | 2/1987 | Mobley et al. | 206/287 |
| 4,732,270 | A | | 3/1988 | Myers et al. | 206/289 |
| 4,782,947 | A | | 11/1988 | Sheiman | 206/279 |
| 4,798,289 | A | | 1/1989 | Mobley | 206/287 |
| 4,802,643 | A | * | 2/1989 | Uys | 403/363 |
| 4,880,113 | A | | 11/1989 | Mobley | 206/287 |
| 5,531,335 | A | | 7/1996 | Chen | 211/124 |
| 5,590,765 | A | | 1/1997 | London | 206/289 |
| 5,887,710 | A | * | 3/1999 | London et al. | 206/287 |

* cited by examiner

*Primary Examiner*—Anita King
(74) *Attorney, Agent, or Firm*—Nath & Associates PLLC; Harold L. Novick; Marvin C. Berkowitz

(57) ABSTRACT

A jointed clamp for attachment to an inside portion of the top of a garment bag has a pair of clamp jaws pivotal connected at their back ends with a hinge pin, and a latching device for releasibly securing the clamp jaws in a closed position. Each of the clamp jaws includes an elongate U-shaped channel, a resilient block seated in the channel and a transversely extending rivet located at the front end of and extending through the resilient block and channel walls. A vertical member is mounted in and extends between the two clamp jaws in a rearward portion thereof, forward of the hinge pin. The resilient block contacts the vertical member which prevents rearward longitudinal movement within the channel. One of the clamp jaws is provided with a plurality of indentations to hold the hooks of coat hangers, and this same clamp jaw is also provided with a vertical tab in the front portion thereof which engages the front end of the seated block.

3 Claims, 2 Drawing Sheets

JOINTED CLAMP FOR GARMENT BAG

FIELD OF THE INVENTION

The present invention relates in general to holders that are mounted inside a garment bag and that hold the hooks of one or more garment hangers on which different items of clothing are hung, the garments being housed in their entirety within the garment bag. In particular, the present invention relates to an improved construction in a jointed clamp that can be mounted inside a garment bag.

BACKGROUND OF THE INVENTION

The present invention is an improvement on jointed clamps used inside garment bags and disclosed in U.S. Pat. No. 4,252,220 reissued as Re 31,075; No. 4,363,388 issued Dec. 14, 1982, 5,590,765 issued Jan. 7, 1997, and 5,887,710 issued Mar. 30, 1999, all incorporated herein in their entirety by reference. In each of these patents, the jointed clamp grasps the hooks of the hangers and is mounted depending downwardly to an inside top portion of, and located entirely inside o, the garment bag. A similar jointed clamp that is a hanger lock and mounted on top of a garment bag so as to grasp the stems of hangers to keep them from falling within the garment bag is disclosed in U.S. Pat. No. 3,566,456 issued Mar. 2, 1971, incorporated herein in its entirety by reference. The present inventor is an inventor in each of these patents.

Garment bags have come into extensive use in recent years and are generally of the type having flexible walls and a cover with a closure means such as a zipper to provide an enclosed housing for garments. The bags are usually provided with means on the top thereof for suspending the bag while loading and unloading the same with garments of long lengths that are usually mounted on a hanger. The garment bag is provided with a clamp that receives and fixedly holds the hanger. Once loaded, the garment bag can be folded for more convenient transport or carried in an extended condition Examples of such garment bags, of which there are many, Garment bags are also disclosed in the following U.S. patents, each of which is also incorporated herein by reference: 3,958,675; 3,221,848; 2,862,586; 2,689,631; 2,671,706; and 2,606,636. These bags also provide examples of the various types of features available with such bags and examples of different mechanisms for retaining the clothes hangers inside the bag. Another example of a jointed clamp is depicted in U.S. Pat. No. 4,640,414, incorporated herein by reference.

Each of the mechanisms for retaining the clothes hangers has various problems and defects. For reasons explained in the above cited U.S. Pat. No. 4,363,388, the clamp disclosed therein (hereinafter referred to as the "388 clamp") overcomes many of the problems of the prior art devices.

The 388 jointed clamp has been manufactured and used successfully in garment bags for over 15 years. Such clamps are comprised of an upper channel hinged portion rigidly mounted to the top of a garment bag, a lower channel hinged portion, and a hinge pin extending through a rear portion. Each channel had substantially parallel walls connected by a corresponding top or bottom. Seated in each respective channel is a resilient block of a yieidable material such as rubber. Each channel wall has vertical slot adjacent the ends of the blocks to facilitate the turning of the terminal edges of the lateral walls to bite into the side surfaces of the blocks along the open faces, without distorting the alignment between the components of the clamp. This retains the block in the channel. Each block protrudes beyond the open faces of the channels and is further retained in its respective channel by being wedged between a rev post and a forward tab that has been bent inwardly from the corresponding bottom or top of the channel so as to bite into the ends of the corresponding resilient blocks. Obviously, the provision of side wails that can be squeezed into an inserted block requires e steps and costs in the manufacturing thereof While generally such jointed clamps have very successfully accomplished their intended purposes, after a period of successful usage, some of the blocks have become loose and occasionally fall out of the channel, thereby rendering not only the jointed clamp unusable, but also the entire garment bag unusable.

Thus, a jointed clamp is needed in which there is a mechanism for retaining the block in its respective channel over many years of usage so that a minor component does not render the entire bag useless. Although the problem was reported to the inventor, the first difficulty was to establish the cause thereof. This was not easy because the problem did not present itself in newly manufactured joint clamps, and most worn clamps were not available for inspection. Thus, a lot of experimentation was done in order to try to simulate the problem of the block not being retained. Many different designs were attempted, including trying different materials, adding an additional rear tab to bite into the block, having different shaped channels, and redesigning the hinge coupling. Occasionally one design or another seemed to have solved the problem, but the solution often caused a significant increase in the cost of manufacturing the clamp. An inexpensive solution that worked was needed, but was difficult to find.

SUMMARY OF THE INVENTION

The present invention provides a solution to the aforementioned long felt, but unsolved need and the disadvantages of the prior art clamps. The solution is both simple in concept and implementation so that not only does the holding blocks remain retained with the corresponding channel throughout the life of the clothing bag, but the added cost is not significant with respect to the overall cost of the clamp. In fact if the savings of various other features which could be eliminated are considered, the implementation of the present invention actually reduces the manufacturing cost of the clamp.

The present invention is directed to a jointed clamp comprising an elongate, U-shaped upper channel, an elongate, U-shaped lower channel, and a hinge pin connecting a rear end of each channel to each other so that they can pivot with respect to each other. In one embodiment of the present invention, a clasp is mounted at a forward end thereof to a forward end section of the lower channel, and is capable of engaging the forward end section of the upper channel. In a more specific embodiment, the clasp includes a handle with a wire loop pivotally mounted thereon, the wire loop bang capable of fitting around the upper channel.. In all embodiments, an upper and lower resilient block is mounted in a corresponding channel and is retained therein by a transverse rivet located in the forward half of each block. A vertical stem or rod is mounted in and extends through and terminates beyond a rear section of each channel and limits the angular opening between the two channels with the result of keeping the rear sections of each block in close proximity to each other so that the rear section of one block retains the rear section of the other block in the channel. In addition, the vertical stem abuts the back end of each block so as to prevent fore and aft movement within the corresponding channel. The lower channel has a vertical tab that abuts the front end of the lower block. Thus, the blocks are retrained in each channel.

A jointed clamp according to the present invention has a single rivet per channel that is used to retain a block therein and eliminate the need for vertical slots in the walls of the channels that are necessary so that an inner section of the chapel walls can be turned into a seated block to forcibly retain it in the channel.

Other features, advantages and benefits of the present invention, are set forth in or obvious from the detailed description of the invention hereinbelow.

DETAILED DESCRIPTION OF THE PRESENTLY PREFERRED EMBODIMENT

Figure 1:
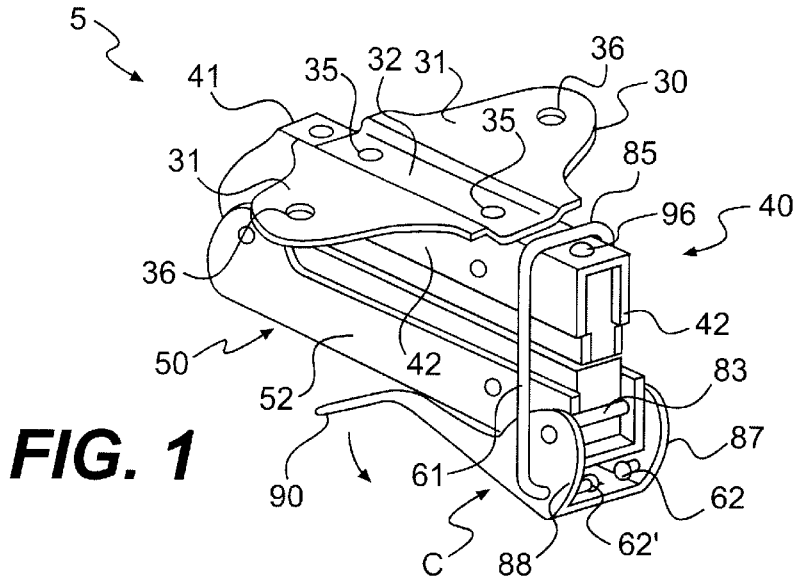
FIG. 1 is a perspective view of an improved clamp adapted to be mounted to the top wall of a garment bag on the interior thereof.
Figure 2:
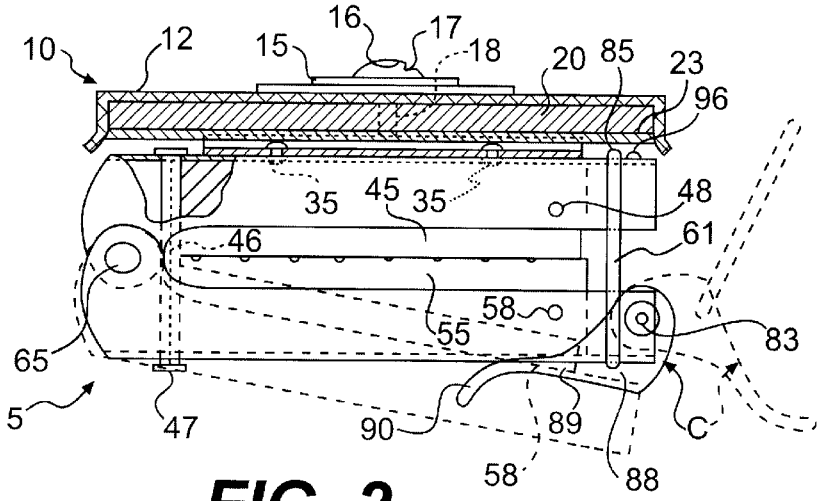
FIG. 2 is a side elevational view, party in cross-section, of the improved clamp.

With reference now to the drawings wherein like numerals refer to like elements throughout the several views,. and in particular with reference to FIGS. 1 and 2, there is depicted an improved jointed clamp 5 in accordance with the present invention that is attached to a clothing bag 10, only a small top section 12 of which is shown, with a wing-shaped mounting plate 30. Bag top section 12 is comprised of a frame member 20 and an internal lining 23. A central escutcheon plate 15 is fastened to the center of top wall 12 with rivets 18 and aids in the integration of a transportation handle(not shown) to clothing bag 10. Escutcheon plate 15 seats a movable spherically-shaped member 16. Member 16 has recesses 17 into which may be inserted a detachable handle that is used for suspending clothing bag 10 from, for example, a closet bar or door. Rivets 18 extend through an outer fabric on top wall 12, frame member 20 and internal lining 23.

Figure 3:
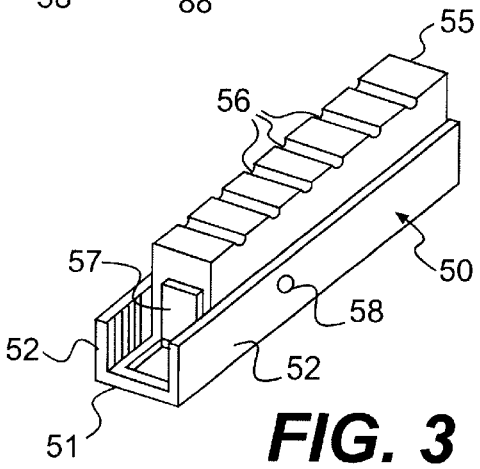
FIG. 3 is a perspective view of the front portion of the lower channel.

As shown in FIG. 1, mounting plate 30 has a pair of outwardly, transversely extending, coplanar wings 31 with apertures 36 in the outer portions thereof integral with the upper sides of a central elongate channel portion 32 so as to provide an elongate depression in the upper plane of mounting plate 30. An upper part of clamp 5 is attached to the underside of mounting plate 30 with rivets 35, the heads of which are accommodated in the central depression of channel portion 32. Rivets 18, which as stated above extend through clothing bag top section 12, also extend through mounting plate 30 and rigidly mount mounting plate 30 to bag 10. Jointed clamp 5 is comprised of an upper clamp jaw or channel 40 and a slightly wider lower clamp jaw or channel 50. Each channel has a font end portion, a middle portion and a back end or rearward portion. The rearward end of upper channel 40 is pivotally joined to the rearward end of lower channel 50 by a hinge member 65 that can be a hinge pin or a rivet, the rearward ends of upper channel 40 fitting between and being received by the rearward ends of lower channel 50. Hinge member 65 extends beyond the external walls of the channels 40 and 50. Upper channel 40 is comprised of a web 41 and integral, spaced-apart and opposed substantially parallel lateral walls 42 extending therefrom which form an open face opposite web 41. As shown in FIG. 3, lower channel 50 has a complementary configuration and is displaced congruously to upper channel 40. Thus lower channel 50 is comprised of a web 51 and integral, spaced apart and opposed substantially parallel lateral walls 52 to present an open face above web 51. A sleeve (not shown) surrounds hinge member 65 between the internal sides of opposed lateral walls 42 and 52 of channels 40 and 50 and reenforces the pivotal joint of hinge member 65.

Respectively mounted in channels 40 and 50 are elongated blocks 45 and 55 that are made of a resilient or yieldable material such as rubber or a plastic material having similar characteristics. Blocks 45 and 55 each have a rectangular cross-section with a planer front, a planar back, planer sides, a planar top and a planar bottom, .and are of the same material. Blocks 45 and 55 have similar dimensions, except that upper block 45 is slightly thinner than lower block 55 so that it can be accommodated in a narrower channel, and is slightly shorter than lower block 55. Blocks 45 and 55 are seated in each respective channel 40 and 50 for all of their length and vertical portions thereof protrude beyond the open faces of channels 40 and 50. As shown in FIG. 3, the upper face of lower block 55 has a plurality of transverse indentations or grooves 56 provided along the length thereof which can retain one or more hooks of hangers and impede the movement of the hooks of hangers along the length of lower block 55.

A simplified stop mechanism for restricting the angular or pivotal movement between pivoted channels 40 and 50 of clamp 30 is provided by a vertical member, such as a rod or stem 46. Stem 46 has flanged caps 47 at its ends such that it resembles a rivet, is slightly longer than the combined heights of channels 40 and 50, extends loosely between webs 41 and 51, and is located slightly in front of hinge member 65. Lower channel 50 can be pivoted downwardly, stem 46 being rocked from its vertical position, unto the bottom surfaces of webs 51 and 61 strike corresponding ones of caps 47, which prevents further pivotal movement and which arrests the rocking movement of stem 46, as shown in FIG 2. The back ends of upper and lower blocks 45 and 55 abut stem 46. In a preferred embodiment, the back ends of blocks 45 and 55 contact stem 46, but they could also be closely spaced in front thereof A clasp C is pivotally mounted to the opposite end of clamp 30 from hinge member 65. Clasp C, disclosed in U.S. Pat. No. 4,252,220, previously incorporated herein by reference, is comprised of a handle 89 and an elongate, essentially U-shaped wire loop 61 having terminal ends 62 and 62' that extend through orifices in the front end portion of handle 89. Each terminal end 62 and 62' of wire loop 61 has a flattened end portion that prevents it from disengaging from upper channel 40 should clasp C be spread apart. Handle 89 has two lateral wings, only wing 88 being shown, that embrace the free end of lower channel 50. Handle 89 is pivotally mounted on the free end of channel 50 by a pintle 83 to permit the pivoting of clasp C. A finger piece 90 at the rearward end of handle 89 permits a user to latch or unlatch clasp C. Clasp C is latched by swinging wire loop 61 into engagement with a retaining protuberance 96 located adjacent the forward edge of the end wall of upper channel 40. Alternatively, loop 61 could engage a slot or channel in web 40 of upper channel 40. The open position of clasp C and the spread apart position of clamp 5 are shown in dashed lines in FIG. 2. By the rotation of handle 89 in a clockwise direction as shown in FIG. 3, clamp 5 tightly clamps channels 50 and 40 together and compresses and retains the hooks of one or more hangers which can be interposed between the protruding portions of resilient blocks 55 and 45.

As mentioned above, the problem in the prior art has been the slippage of blocks 55 out of their respective channel 40 or 50. In the present invention, this problem has been principally solved by a transverse member 58 which extends through the channel walls and block 55 located therebetween. Block slippage is further retaded by a vertical tab 57 that extends upwardly from web 51, and by the reward ends of blocks 45 and 55 always being closely spaced from each other as a result of vertical stem 41 limiting the pivotal movement of channels 40 and 50. Vertical tab 57 extends upwardly from the front portion of web 5land can be produced, for example, by a stamping die. Vertical stem 41 which extends vertically in the rear portion of channel 50 prevents longitudinal movement of resilient block 55 within lower channel 50, block 55 being wedged between vertical stem 41and vertical tab 57 Transverse retaining member 58, which in the present embodiment is a rivet, but could also be a pin or screw, is selectively located in a front portion of lower channel 50 and extends through a first outside channel wall 52, a lower portion of lower block 55, and a second channel wall 52. Retaining member 58 prevents vertical movement of the front part of block 55 and retains block 55 in lower channe[008c] 50.

A similar transverse retaining member or rivet 48 is selectively located in a mid portion of block 45, extending through a first outside channel wall 52, an upper portion of upper block 45, and a second channel wall 52. Retain member 48 retains upper block 45 in upper channel 40. However, there is no corresponding vertical tab in upper channel 40 to tab 57 of lower channel 50. A vertical tab is not needed in upper channel 40 to prevent longitudinal movement because there are essentially no longitudinal forces applied to upper block 45, and retaining member 48 has been found to be sufficient, This is in contradisction to the longitudinal forces being applied to lower block 55 by the hangers being supported thereon.

It has also been found that only one transverse rivet 48 or 58 is required to effectively retain upper block 45 or lower block 55 within its corresponding channel 40 or 50 if that rivet is located in the forward portion of the corresponding block This is because vertical stem 46 limits the opening angle of clamp 5 and the corresponding amount of separation between blocks 45 and 55. Thus, the rearward portions of each block 45 and 55 is closely spaced from each other, thereby preventing the rearward portions from disengaging from the corresponding channel. On the other hand, if transverse rivet 58 were located too far forward, then it would interfere with the operation of the pivoting of handle 89 of clasp C, or block 55 could split with use. Accordingly, the best longitudinal position that was found for rivet 58 was in the rear part of the forward most quarter portion of block 55. The longitudinal positioning of trivet 48,in upper block 45 was not so critical, but for ease of manufacture, its longitudinal position was chosen to be in a vertical alignment with rivet 57. The best vertical position of each rivet was found to be as far down or up from the upper or lower surface of blocks 45 and 55, respectively, as the corresponding rivet was from the forward most end of the block. This located the rivet in the respective lower or upper half of walls 42 and 52, and in the respective lower or upper half of blocks 45 and 55.

Thus, it has been found that rivet 48 is all that is necessary to prevent longitudinal movement and the elimination of a vertical tab in upper channel results in a cost savings and a saving in manufacturing time. In addition, a certain percentage of channels are damaged by the stamping process that is used to make vertical tab 57, and this possibility of damaging upper channel 40 is eliminated.

Figure 4:
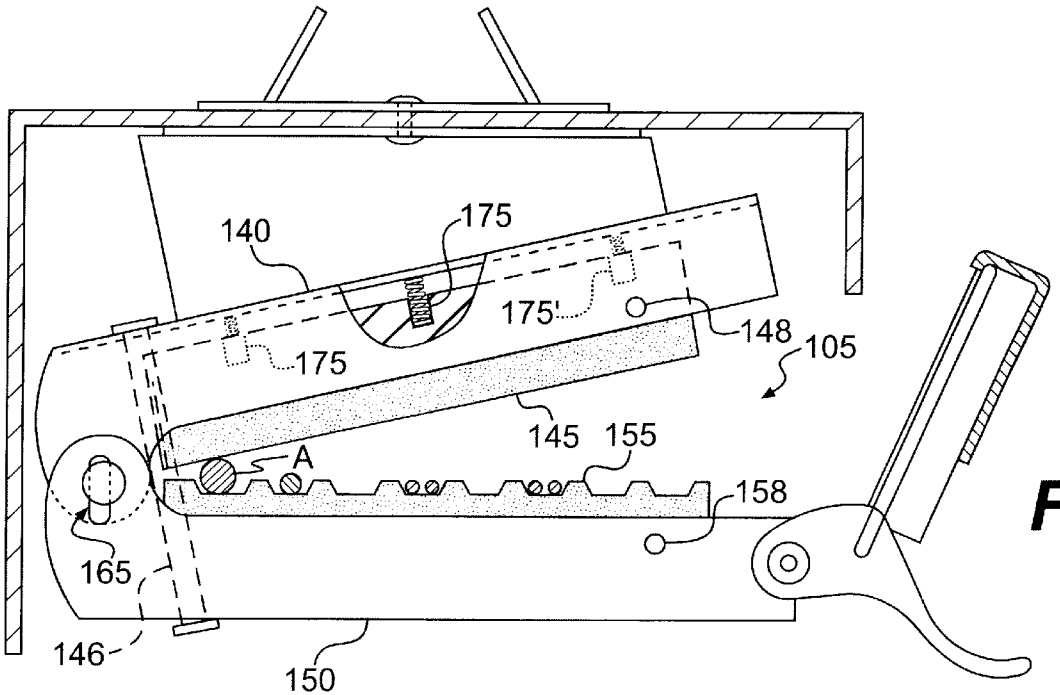
FIG. 4 is a side elevational view, partly in cross-section, of a second embodiment of an improved clamp.

Referring now to FIG. 4, a second embodiment of an improved jointed clamp 105 is depicted. Clamp 105, as more fully described in recently issued U.S. Pat. No. 5,887,710, comprised of an upper clamp jaw 140 and a lower clamp jaw 150 with a connecting structure 165 between them permitting both rotational and transactional movement. A stem or limiting pin 146, holds lower clamp jaw 150 approximately horizontally in a release position, as depicted in FIG. 4. Firm, yet somewhat resilient blocks 145 and 155 are resiliently mounted in corresponding clamp jaws 140 and 150. Resilient blocks 145 and 155, as can be resilient blocks 45 and 55, are made of an elastomeric material having a durometer of from approximately 50 to approximately 60. Block 150 is resiliently mounted with a coil spring 175 and block 160 is resiliently mounted with a coil spring (not shown). Corresponding transverse ret members 148 and 158 extend through the round orifices in both sides of clamp jaws 140 and 150, respectively, and through a vertical slot (not shown) in blocks 145 and 155. The vertical slot permits sight vertical movement of blocks 145 and 155, while also preventing the full removal thereof from the channels of Clamp jaws 140 and 150.

Figure 5:
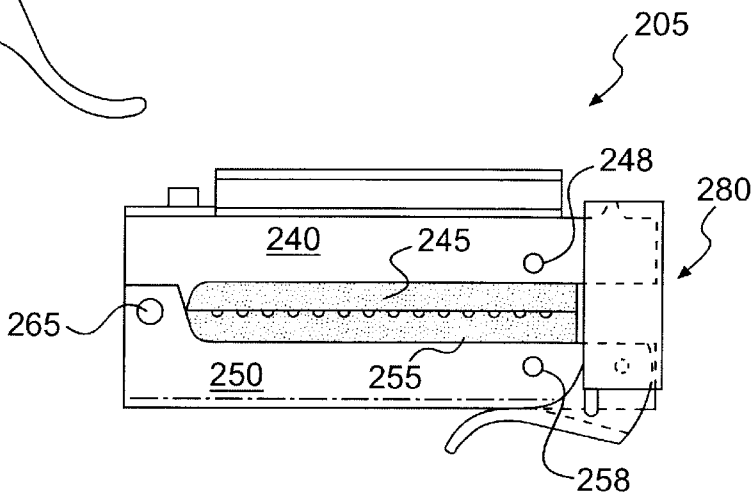
FIG. 5 is a side elevational view of a third embodiment of an improved clamp.

Referring now to FIG. 5, a third embodiment of an improved jointed clamp 205 is depicted. Clamp 205, as more fully described in recently issued U.S. Pat. No. 5,590,765 is comprised of an upper clamp jaw 240 and a lower clamp jaw 250 connected adjacent their respective rear ends with a hinge pin 265, and a latching device 280 that releasibly secures jaws 240 and 250 together, as depicted in FIG. 5. Clamp jaws 240 and 250 are comprised of a channel having an inner space (not shown). A resilient block 245 is mounted in the inner space of clamp jaw 240 and a resilient block 255 is mounted in the inner space of clamp jaw 250. Corresponding transverse retaining members 248 and 258 extend through round orifices in both sides of clamp jaws 140 and 150 and in blocks 145 and 155, respectively. Members 248 and 258 retain blocks 245 and 255 within the channels of clamp jaws 240 and 250, respectively.

The invention being thus described with respect to three specific embodiments thereof, it will be obvious that the same may be varied in many ways. Such variations are not to be regarded as a departure from the spirit and scope of the invention and all such modifications are intended to be included with the scope of the claims as set forth hereinbelow.

I claim:

1. A jointed clamp for a garment bag, said clamp comprising:

an elongate U-shaped upper channel having a front end portion, a middle portion and a back end portion, and comprised of two longitudinally extending, substantially parallel walls spaced apart in a transverse direction and defining a vertical plane, an integral top portion that defines a transverse plane, and a bottom opening;

a mounting Plate located on an outer side of said upper channel top portion;

an elongate U-shaped lower channel having a middle portion and a back end portion, and comprised of two longitudinally extending, substantially parallel walls spaced apart in a transverse direction and defining a vertical plane, an integral bottom portion that defines a transverse plane, and a top opening;

a laterally disposed hinge pin located in said back portions of said channels and pivotally connecting said upper and lower channels together, said upper and lower channels having the open bottom and top facing one another;

an upper solid block of resilient material seated within said upper channel;

a lower solid block of resilient material seated within said lower channel, said upper and lower materials protruding beyond the respective channel openings;

a clasp pivotally mounted on said front end portion of said bottom channel walls of said lower channel that can fit around said front portion of said upper channel with the result that said upper and lower channels can be locked together in a closed position;

a vertical member loosely mounted in and extending between said upper channel and said lower channel, said vertical member having a length such that a range of relative pivotal movement between said upper and lower channel from said closed position to an open position is limited to an angle in which a rear portion of said upper and lower resilient materials remain disposed adjacent said vertical member throughout the range of relative pivotal movement;

a single upper transverse member that extends through a lower half of an upper section of said front end portion of said upper channel walls and extends through a forward upper half portion of said upper resilient material; and a single lower transverse member that extends through an upper half of a lower section of said front end portion of said bottom channel walls behind where said clasp is pivotally mounted thereto and extends through a forward lower half portion of said lower resilient material, with the result that said upper and lower resilient materials are positively, respectively retained in said upper and lower channels.

2. A jointed clamp as claimed in claim 1, wherein said upper and lower resilient materials have a rectangular cross-section, each of said upper and lower blocks having a front end, a back end, and upper side and a lower side;

wherein said upper and lower transverse members are rivets;

wherein the distance from said front end of said upper block to said upper rivet is about the same as the distance from said upper side of said upper block to said upper rivet; and wherein the distance from said front end of said lower block to said lower rivet is about the same as the distance from said lower side of said lower block to said lower rivet.

3. A jointed clamp for a garment bag, said clamp comprising:

a first and a second clamp jaw, each having a back end, a front end, an inner side and an outer side;

a pivot member pivotally connecting said clamp jaws adjacent said back ends thereof such that said clamp jaws can be moved between a closed position in which the clamp jaws are mutually aligned in a substantially parallel position and an open position in which the clamp jaws are in a mutually angular position;

a latching device pivotally mounted on a front end portion of one of said clamp jaws and having a latched position in which said clamp jaws are secured in said closed position, and an unlatched position in which said clamp jaws are free to rotate relative to each other;

each said clamp jaw further comprising:

a U-shaped channel having two substantially parallel, elongate side walls, an integral outer wall, and an open inner side, and having a front end portion, a middle portion and a back end portion, an elongate, resilient block having an inner portion and an outer portion and having a rectangular cross-section with a front end and a back end, said block being seated within said channel with the inner portion thereof extending inwardly of said channel walls and with the back end contacting a vertical member; and a single transverse rivet that extends through a section of said front end portion of said channel walls that is closer to said open inner side, and extends through a forward end section of said inner portion of said block with the result that said block is positively retained in said channel;

said vertical member mounted in and extending between said back end of said clamp jaws with the result that a range of relative pivotal movement between said first and second clamp jaws from a closed position to an open position is limited such that the back ends of said upper and lower blocks remain in a closely spaced relationship to one another.

* * * * *